United States Patent [19]

Clark

[11] Patent Number: 4,993,303

[45] Date of Patent: Feb. 19, 1991

[54] HORNETTE

[76] Inventor: John Clark, 711 Amsterdam Ave., #18N, New York, N.Y. 10025

[21] Appl. No.: 317,000

[22] Filed: Feb. 28, 1989

[51] Int. Cl.[5] ..... G10D 7/10

[52] U.S. Cl. ..... 84/394; 84/387 R

[58] Field of Search ..... 84/387, 388, 389, 390, 84/393, 394

[56] References Cited

U.S. PATENT DOCUMENTS

| | | | |
|---|---|---|---|
| 879,322 | 2/1908 | Riedl | 84/394 |
| 1,642,783 | 9/1927 | Lehmann | 84/394 |
| 1,764,562 | 6/1930 | Gulick | 84/389 |
| 2,790,345 | 4/1957 | Greenleaf | 84/388 |
| 2,987,950 | 6/1961 | Kent | 84/388 |
| 3,329,056 | 7/1967 | Kostenko | 84/388 |
| 3,529,505 | 9/1970 | Brooks | 84/387 |
| 3,686,995 | 8/1972 | Marzan | 84/389 |
| 3,933,078 | 1/1976 | Veneklasen | 84/387 |
| 4,178,830 | 12/1979 | Ramirez | 84/388 |
| 4,559,859 | 12/1985 | Pilczuk | 84/394 |

FOREIGN PATENT DOCUMENTS

| | | | |
|---|---|---|---|
| 13668 | 1/1855 | France | 84/389 |

OTHER PUBLICATIONS

Computerized Search Results.

*Primary Examiner*—Lawrence R. Franklin

*Attorney, Agent, or Firm*—Kane, Dalsimer, Sullivan, Kurucz, Levy, Eisele and Richard

[57] ABSTRACT

A brass wind instrument is disclosed which has substantially the same range as a French Horn but has a forward facing bell for greater projection. Further, the bell is substantially that of a tenor trombone.

The instrument includes a rotary valve for changing the key from an F-alto to a B-flat.

The instrument includes a French Horn lead pipe.

16 Claims, 3 Drawing Sheets

HORNETTE

BACKGROUND OF THE INVENTION

1. Field of the Invention

The present invention relates to a valved brass wind musical instrument which is similar to a French Horn, but has a wider variety of applications.

2. Description of the Prior Art

The French Horn is a well-known orchestral musical instrument which is designed for use in a symphony orchestra and small chamber music ensembles. However, the French Horn is not suitable for many other musical applications such as rock and roll, jazz, or marching bands due to its lack of technical facility and inability to produce a satisfactorily high volume. More particularly, the French Horn is not satisfactory for such applications in that the bell points backwards and the musician's hand must be held in the bell. Both of these factors help the player produce the rich, dark tone through the horn as is required in a symphony, but these characteristics are detrimental for applications wherein a brighter sound with more projection is required.

The rear-pointing configuration of the French Horn frequently projects the sound into undesirable areas such as the French Horn player's arm or clothing, or the musicians or musicians' equipment to the rear of the French Horn player. Moreover, other sounds behind the player, such as the timpani, drums, bass and amplifiers may be projected into the bell of the French Horn, not only interfering with the Horn's sound but also being felt by and interfering with the player's embouchure.

Furthermore, it is an essential part of the French Horn playing position to hold the right hand in the bell of the horn. This is required in order to control the pitch in the higher registers as is necessary to maintain the characteristic dark tone of the French Horn. However, this characteristic inhibits a strong, bright projection of sound as is required in the aforementioned non-orchestral applications.

Moreover, the French Horn's shape, weight and size is not well-adapted to marching or playing in the standing position, particularly when a free hand is needed in mobile situations for turning sheets of music or adjusting the electronic controls on amplifiers which are proximate to the musician. A previous attempt to make a valved brass wind instrument with greater projection characteristics is disclosed in U. S. Pat. No. 4,178,830. However, partly due to the fact that a French Horn-sized bell is used, this instrument is bulky and requires two hands to hold the instrument.

Previous solutions to providing an instrument to take the place of the French Horn in marching band, jazz or rock and roll applications, such as the Mellophonium or the aforementioned U. S. Pat. No. 4,178,830, have been limited to single key, typically F, B-flat or F-alto. Each key has certain disadvantages. A horn in the key of F is extremely difficult to control in the high register. A horn in the key of B-flat can not produce all the notes in the low register. Similarly, a horn in the key of F-alto leaves out almost an entire octave of the range in the low register.

Finally, previous solutions, such as the Mellophonium, to providing an instrument to take the place of the French Horn in marching band, jazz or rock and roll applications have compromised in the area of the lead pipe and the mouthpiece. Most of the instruments have had a different size lead pipe from the French Horn, requiring the French Horn player to use a sleeve-type adapter to attach his regular mouthpiece to the instrument, or to use a different type or size of mouthpiece with which he may be unfamiliar. Furthermore, most of these lead pipes have been more cylindrical, such as on a Trumpet or Trombone, than conical in design, such as on a French Horn. The use of a cylindrical rather than conical lead pipe changes the sound, and the blowing characteristics of the instrument, thereby making it difficult for the French Horn player to adapt to the instrument.

It is therefore an object of the present invention to provide a brass instrument with the technical facility, volume, projection, and tone which are required by marching band, jazz or rock and roll applications.

It is therefore a further object of the present invention to provide a brass instrument with a forward pointing bell.

It is therefore a further object of the present invention to provide a brass instrument which is easily adaptable to standing or marching playing positions, and does not require the insertion of the musician's hand into the bell during playing, but rather allows the musician to have a free hand for turning musical sheets and adjusting the controls of amplifiers proximate to the musician.

It is therefore a still further object of the present invention to provide a brass instrument with a range of keys which will provide the necessary upper and lower range for marching band, jazz and rock and roll applications.

It is therefore a final object of the present invention to provide a brass instrument with all of the above objects wherein a French Horn mouthpiece is used without the need for an adapter.

SUMMARY OF THE INVENTION

The above and other beneficial objects and advantages are attained in accordance with the present invention by providing a valved brass wind musical instrument shaped like a flugel horn or cornet, but larger, which is pitched in the key of F-alto with a conversion to B-flat thereby allowing a full range of notes to be played. The bell of the instrument points forward. The bell is similar in size to that of a tenor trombone and therefore does not require the musician to hold his hand in the bell to control the high register. This allows the instrument to be played without muffling. The instrument is sufficiently light that a musician can stand or march with the instrument while holding the same in one hand. The instrument uses a French Horn lead pipe so as to allow the use of a French Horn mouthpiece thereby allowing the French Horn musician to more comfortably play this instrument.

DETAILED DESCRIPTION OF THE PREFERRED EMBODIMENT

Figure 1:
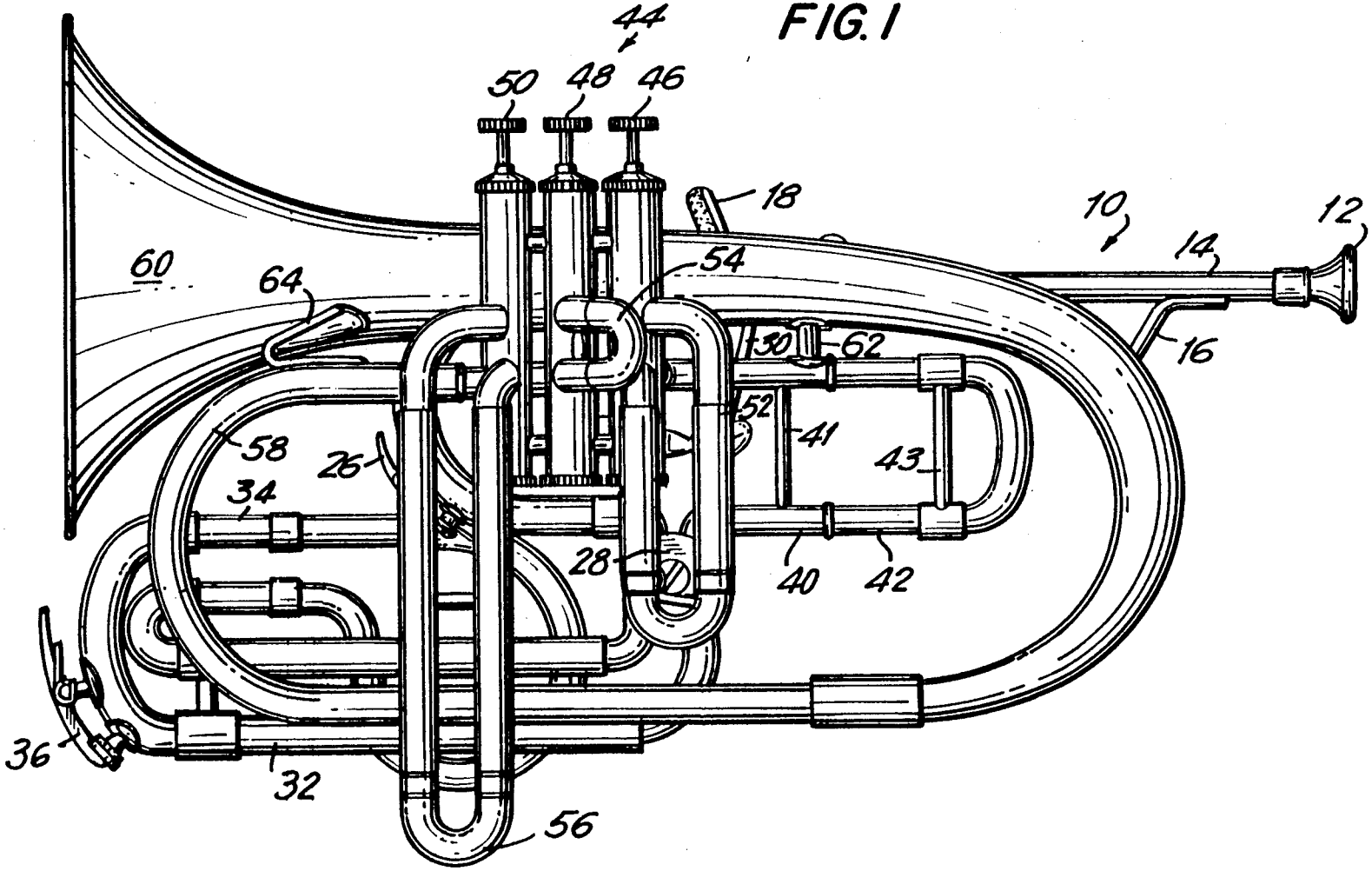
FIG. 1 discloses a left side plan view of the present invention.
Figure 2:
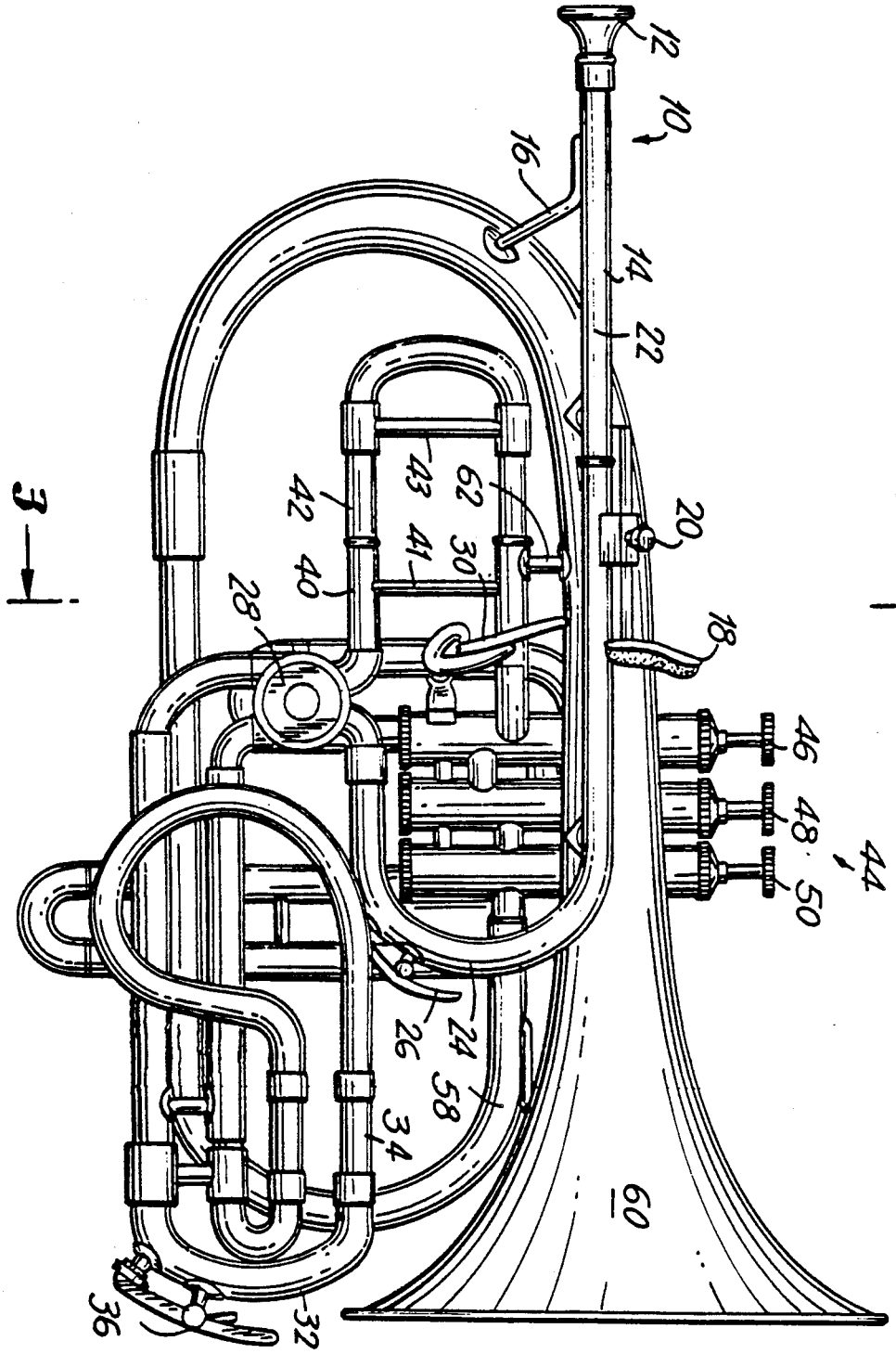
FIG. 2 discloses a right side plan view of the present invention.

Referring now to the drawings in detail wherein like numerals indicate like elements throughout the several views, FIGS. 1 and 2 disclose side views of hornette 10, a brass wind instrument. Hornette 10 includes a French Horn mouthpiece 12 which is engaged by a lead pipe 14 with an initial inside diameter of 5/16 inch. Support 16 provides a secure position for lead pipe 14. Hand support 18, which is slidably adjustable on clamp 20, provides means for the musician to support his hand and to more tightly grip the hornette 10, so that hornette 10 can be held and played with one hand similar to a trumpet or cornet. Lead pipe 14 includes a straight and an inwardly curved portion, 22 and 24, respectively. The length of straight and inwardly curved portions 22 and 24 of lead pipe 14 is approximately sixteen inches. The lower portion of inwardly curved portion 24 of lead pipe 14 includes a water key 26. The inner diameter of inwardly curved portion 24 of lead pipe 14 reaches approximately ½ inch as it joins rotary valve 28.

Figure 3:
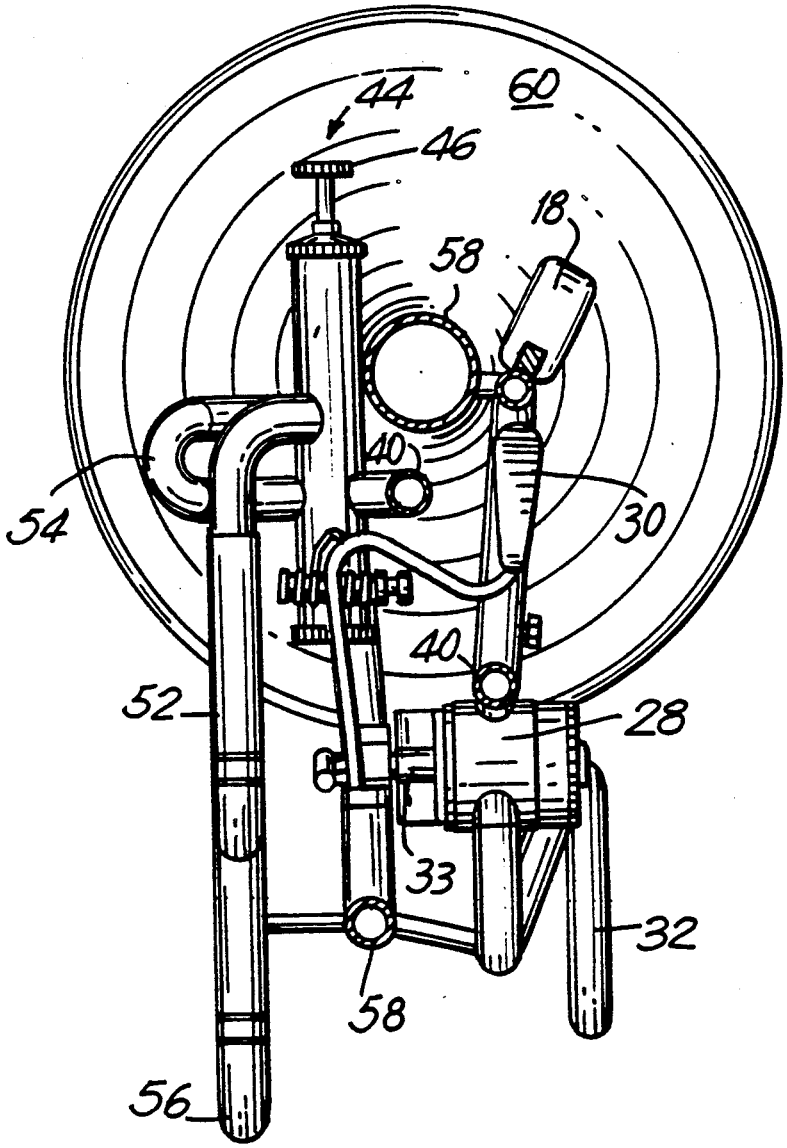
FIG. 3 discloses a sectional view along line 3—3 as shown in FIG. 2.

Rotary valve 28 includes thumb lever 30. Thumb lever 30 reaches up to be proximate to hand support 18 so as to allow the musician to operate thumb lever 30 while playing hornette 10. When the musician does not push thumb lever 30, rotary valve 28 is in a position so as to close the B-flat extension 32 (that is, the air path does not include the B-flat extension 32), and the hornette 10 has an F-alto key. In order to open rotary valve 28 so as to include the B-flat extension 32 in the air path, the player uses his thumb to push thumb lever 30 in a direction away from the mouthpiece thereby rotating stem 33 (see FIG. 3) of rotary valve 28 thereby changing the key of the hornette 10 to B-flat. This allows the horn to be played over a greater range. Rotary valve 28 is spring-loaded so as to return to a closed position when the musician ceases pressure on thumb lever 30. Rotary valve 28 and thumb lever 30 are shown in detail in FIG. 3.

Those skilled in the art will realize that changing the key of hornette 10 from F-alto to B-flat results in a harmonic interval of a perfect fifth—three and a half steps.

B-flat extension 32 travels a relatively compact serpentine path totalling approximately forty inches which is added to the air path. However, the exact length of the B-flat extension 32, must be adjustable for tuning purposes, therefore a tuning slide 34 is included which can raise or lower the pitch slightly by being pulled out or pushed in by approximately one inch. Further, B-flat extension 32 includes water key 36.

The air path exits from rotary valve 28 and enters intermediate pipe 40. Intermediate pipe 40 includes main tuning slide 42 which ranges in size from eight and a half to ten and a half inches long. The position of main tuning slide 42 is used to tune the instrument regardless of whether the B-flat or the F-alto key is chosen. Intermediate pipe 40 has two parallel legs with support 41 therebetween. Main tuning slide 42 is C-shaped with support 43 between the legs thereof. Tuning slide 42 joins the two parallel legs of intermediate pipe 40. Intermediate pipe 40 leads to piston valve assembly 44, which includes first, second and third valves, 46, 48 and 50, respectively. These valves, as in most brass instruments such as the cornet, are used to lower the pitch one step, one half step, and one and a half steps, respectively. This lowering of the tone is accomplished by the valves 46, 48 and 50, when depressed, diverting the air path through valve slides 52, 54 and 56, respectively. These valve slides have a length of 10, 5, and 15 inches respectively, with tuning slide capability to increase the lengths by ¾ inch, ½ inch, and 1¼ inch, respectively.

The air path exits from third piston valve 56 to bell tubing 58 which leads to bell 60 via substantially a 360 degree oval path. Bell tubing 58 has a diameter of five eighths of an inch as it leaves third piston valve 56. The combined length of bell tubing 58 and bell 60 is approximately 42½ inches. The bell 60 is substantially similar to that of a tenor trombone, and has a diameter of 7½ inches thereby resulting a compact size which is easily manageable. Further, this reduced size of bell, in place of the French Horn sized bell, allows for more stable tones in the higher register, without the need for the musician to place his hand in the bell, consequentially muffling the projection of the instrument.

The longitudinal axis of lead pipe 14 is substantially parallel to the longitudinal axis of bell 60, with bell 60 pointing forward thereby resulting in a strong forward projection of sound from hornette 10.

In order to provide a stable configuration, bell 60 is attached to lead pipe 14 by support 16, attached to intermediate pipe 40 by support 62 and attached to bell tubing 58 by support 64.

Further, supports 66 and 68 hold the straight portion 22 of lead pipe 14 a sufficient distance from bell 60 so as to permit lead pipe 14 to vibrate freely without interference from bell 60.

The approximate resulting dimensions of hornette 10 are a length of 16½ inches, a height of 12½ inches, and a width of 7½ inches.

To play hornette 10, the musician produces sound in the same way as in all conventional brass instruments, by pressing his lips to the mouthpiece 12 tightly and blowing air through it, causing the column of air inside the hornette 10 to vibrate. He changes the pitch by adjusting the force of the air blown into the mouthpiece 12, and by the exact tightness and position of his lips (embouchure). The musician does not push thumb lever 30 if the desired key is F-alto, and does push thumb lever if the desired key is B-flat. Further, tonal changes are made by effecting various permutations of the open and closed positions of valves 46, 48 and 50. Tuning variations in the hornette 10 are accomplished by adjusting tuning slides 34 and 42.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A brass wind instrument comprising:

a mouthpiece;

a lead pipe with a first end engaging said mouthpiece and a second end engaging a tonal valve, wherein an air path is formed from said mouthpiece to said tonal valve;

wherein said lead pipe and said mouthpiece are substantially equivalent to those of a French Horn;

a tonal extension;

an intermediate pipe;

a valve assembly including a plurality of valves, various permutations of said valves extending the air path by lengths corresponding to successive half-step increments in a tone of said instrument;

bell tubing;

a bell substantially equivalent to that of a tenor trombone bell;

said tonal valve having a closed and an open position, said closed position diverting the air path directly through the valve to said intermediate pipe, said open position diverting the air path from said valve through said tonal extension back to said tonal valve thereby changing a key of the instrument;

wherein the air path exits from said tonal valve to said intermediate pipe;

wherein the air path exits from said intermediate pipe to said valve assembly;

wherein the air path exits from said valve assembly to said bell tubing; and wherein the air path exits from said bell tubing to said bell.

2. The instrument of claim 1 wherein said tonal valve is a rotary valve including a thumb extension which extends from said rotary valve toward said lead pipe thereby allowing the musician to operate said tonal valve while playing the instrument.

3. The instrument of claim 2 wherein said valve assembly comprises three slide valves.

4. The instrument of claim 3 wherein said three slide valves are substantially in a cornet-type configuration.

5. The instrument of claim 4 wherein said a longitudinal axis of said bell is parallel with said lead pipe, and said bell facing away from said lead pipe.

6. The instrument of claim 5 wherein when said rotary valve is open, said tonal extension increases the air path so as to lower the key of the instrument by a harmonic interval of a perfect fifth.

7. The instrument of claim 6 wherein the key of the instrument with said tonal valve closed is F-alto, and the key of the instrument with said tonal valve open is B-flat.

8. The instrument of claim 7 wherein said bell tubing traverses substantially 360 degrees from said valve assembly to said tenor trombone bell.

9. The instrument of claim 8 wherein bell tubing is substantially oval shaped.

10. The instrument of claim 9 wherein said lead pipe traverses substantially 180 degrees from said mouthpiece to said tonal valve.

11. The instrument of claim 10 wherein said intermediate pipe traverses substantially 180 degrees from said tonal valve to said valve assembly.

12. The instrument of claim 11 wherein said intermediate pipe includes a main tuning slide.

13. The instrument of claim 12 wherein said tonal extension includes an auxiliary tuning slide.

14. The instrument of claim 13 wherein said lead pipe includes a first water key.

15. The instrument of claim 14 wherein said tonal extension includes a second water key.

16. The instrument of claim 15 wherein said lead pipe includes a slidably adjustable hand support.

* * * * *